US006637133B2

(12) United States Patent
Theurer et al.

(10) Patent No.: US 6,637,133 B2
(45) Date of Patent: Oct. 28, 2003

(54) BALLAST CLEANING MACHINE

(75) Inventors: Josef Theurer, Vienna (AT); Herbert Wörgötter, Gallneukirchen (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/107,684

(22) Filed: Mar. 27, 2002

(65) Prior Publication Data

US 2002/0157839 A1 Oct. 31, 2002

(30) Foreign Application Priority Data

Apr. 26, 2001 (AT) ..... 331/2001 U

(51) Int. Cl.[7] ..... E02F 5/22
(52) U.S. Cl. ..... 37/104; 104/7.1
(58) Field of Search ..... 37/104, 105, 106, 37/107; 171/16; 104/2, 5, 7.1, 7.3, 12; 105/459

(56) References Cited

U.S. PATENT DOCUMENTS

| | | | | | |
|---|---|---|---|---|---|
| 3,976,142 | A | * | 8/1976 | Plasser et al. | 171/16 |
| 4,614,238 | A | | 9/1986 | Theurer et al. | |
| 4,630,541 | A | * | 12/1986 | Theurer et al. | 104/7.2 |
| 5,090,483 | A | * | 2/1992 | Theurer et al. | 171/16 |
| 5,090,484 | A | * | 2/1992 | Theurer et al. | 171/16 |
| 5,094,018 | A | * | 3/1992 | Theurer et al. | 37/104 |
| 5,257,580 | A | | 11/1993 | Theurer et al. | |
| 5,289,648 | A | * | 3/1994 | Theurer et al. | 37/104 |
| 5,394,944 | A | | 3/1995 | Theurer et al. | |
| RE35,788 | E | * | 5/1998 | Theurer et al. | 37/104 |
| 5,778,795 | A | * | 7/1998 | Kusel et al. | 104/3 |
| 5,937,548 | A | * | 8/1999 | Theurer et al. | 37/104 |
| 6,158,352 | A | * | 12/2000 | Theurer et al. | 104/7.2 |

FOREIGN PATENT DOCUMENTS

| | | |
|---|---|---|
| DE | 240 043 | 8/1985 |
| DE | 43 43 148 | 10/1994 |
| EP | 0 629 744 | 5/1994 |
| FR | 714 645 | 7/1930 |
| FR | 1029167 | 12/1950 |

* cited by examiner

*Primary Examiner*—Robert E. Pezzuto
*Assistant Examiner*—Nathan Mammen
(74) *Attorney, Agent, or Firm*—Collard & Roe, P.C.

(57) ABSTRACT

A ballast cleaning machine is a machine frame supported on the track by undercarriages, one of the undercarriages at an end of the machine frame being displaceable in the longitudinal direction. Two vertically and laterally adjustable endless ballast excavating chains are sequentially arranged in the longitudinal direction for excavating ballast from a ballast bed and mounted on the machine frame between the undercarriages, and drives vertically and laterally adjust, and revolve, each endless ballast excavating chain. At least two track lifting devices are mounted on the machine frame, and a screening installation for cleaning ballast is mounted on a car linked to the machine frame. A first conveyor arrangement conveys the ballast excavated by the two endless ballast excavating chains to the screening installation, and a second conveyor arrangement distributed the cleaned ballast from the screening installation to the ballast bed.

6 Claims, 1 Drawing Sheet

BALLAST CLEANING MACHINE

BACKGROUND OF THE INVENTION

1. Field of the Invention

The present invention relates to a ballast cleaning machine for cleaning a ballast bed supporting a track, which comprises a machine frame extending in a longitudinal direction and supported on the track by undercarriages for movement in an operating direction, two vertically and laterally adjustable endless ballast excavating chains sequentially arranged in the longitudinal direction for excavating ballast from the ballast bed and mounted on the machine frame between the undercarriages, drives for vertically and laterally adjusting, and for revolving, each endless ballast excavating chain, two track lifting devices mounted on the machine frame, a screening installation for cleaning ballast, a first conveyor arrangement for conveying the ballast excavated by the two endless ballast excavating chains to the screening installation, and a second conveyor arrangement for distributing the cleaned ballast from the screening installation to the ballast bed.

2. Description of the Prior Art

Ballast cleaning machines of this type have been disclosed in published German patent application No. 43 43 148 A1, French patent No. 1,029,167 and German Democratic Republic patent No. 240 043. These machines have a machine frame supported on undercarriages at the ends of the machine frame for movement on the track in an operating direction, and two excavating chains are mounted on the machine frame immediately following each other in the operating direction. A ballast cleaning screening installation is arranged between the two ballast excavating chains. While the machine continuously advances along the track, the first excavating chain, as seen in the operating direction, excavates the ballast and conveys it to the screening installation, and the second, trailing excavating chain removes the soil underlying the ballast bed. The removed soil is conveyed to trailing storage cars. Before the cleaned ballast is distributed from the screening installation, a protective sand layer is laid on the subgrade.

French patent No. 714,645 shows an arrangement of four endless bucket chains for raising excavated ballast and convey it to a screening installation.

Another machine for rehabilitating a ballast bed is disclosed in European patent application No. 0 629 744 B1. A first excavating chain excavates a layer of ballast, and the excavated ballast is comminuted in a stone crusher. The comminuted ballast is distributed on the excavated ballast bed and compacted to serve as a protective layer over the subgrade. A second excavating chain mounted on a second machine frame removes soil, which is replaced by the protective layer, whereupon the track is laid. In a subsequent operating stage, new ballast is introduced to provide a ballast bed.

SUMMARY OF THE INVENTION

It is the primary object of this invention to provide a ballast cleaning machine of the first-described type, which achieves a particularly high ballast cleaning efficiency with two endless ballast excavating chains which encompass the track.

The above and other objects are accomplished in accordance with the invention with a ballast cleaning machine for cleaning the ballast bed supporting a track, which comprises a machine frame extending in a longitudinal direction and supported on the track by undercarriages for movement in an operating direction, one of the undercarriages at an end of the machine frame being displaceable in the longitudinal direction. Two vertically and laterally adjustable endless ballast excavating chains are sequentially arranged in the longitudinal direction for excavating ballast from the ballast bed and mounted on the machine frame between the undercarriages, with drives for vertically and laterally adjusting, and for revolving, each endless ballast excavating chain. A respective operator's cab is mounted on the machine frame in view of each endless ballast excavating chain, a control for the drives being arranged in each operator's cab. Furthermore, at least two track lifting devices are mounted on the machine frame, a screening installation for cleaning ballast is mounted on a car linked to the machine frame, a first conveyor arrangement conveys the ballast excavated by the two endless ballast excavating chains to the screening installation, and a second conveyor arrangement distributes the cleaned ballast from the screening installation to the ballast bed.

A machine combining these features substantially enhances the ballast excavating capacity in a ballast cleaning operation so that very large screening installations may be used for cleaning the large volume of excavated ballast. By mounting two endless ballast excavating chains on a common machine frame, in connection with a correspondingly large excavating section obtained by the displaceable undercarriage, construction costs compared to the use of two machines are reduced despite the increase in operating efficiency.

BRIEF DESCRIPTION OF THE DRAWING

The above and other objects, features and advantages of the invention will become more apparent from the following detailed description of now preferred embodiments, taken in conjunction with the accompanying drawing wherein.

DETAILED DESCRIPTION OF THE PREFERRED EMBODIMENTS

Figure 1:
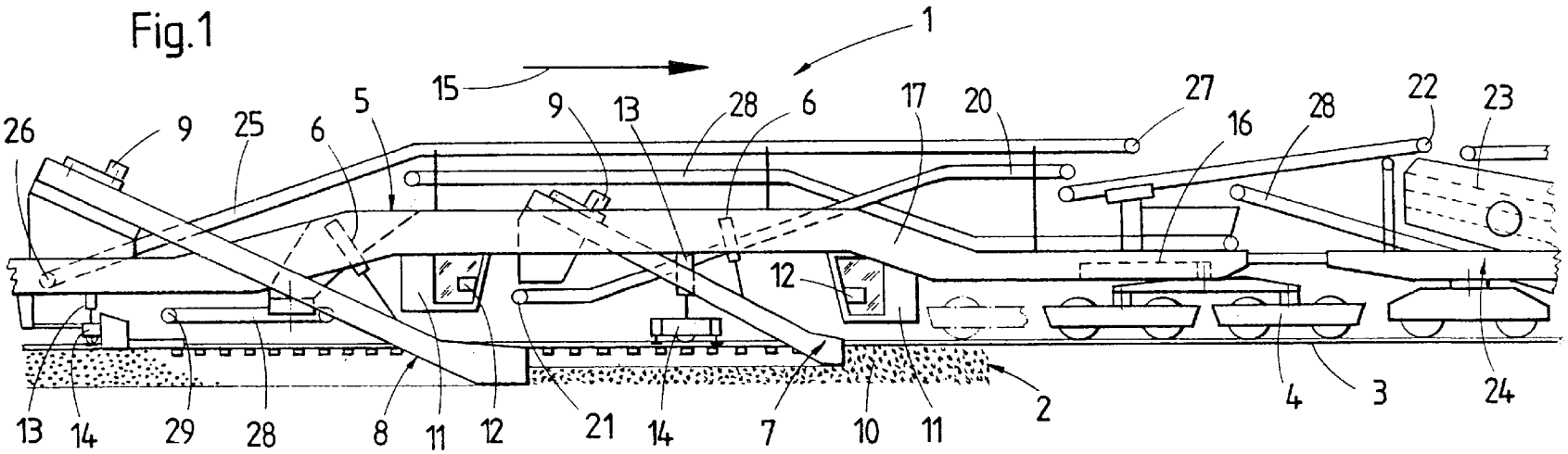
FIG. 1 illustrates a side elevational view of the front part of a ballast cleaning machine according to the present invention.
Figure 2:
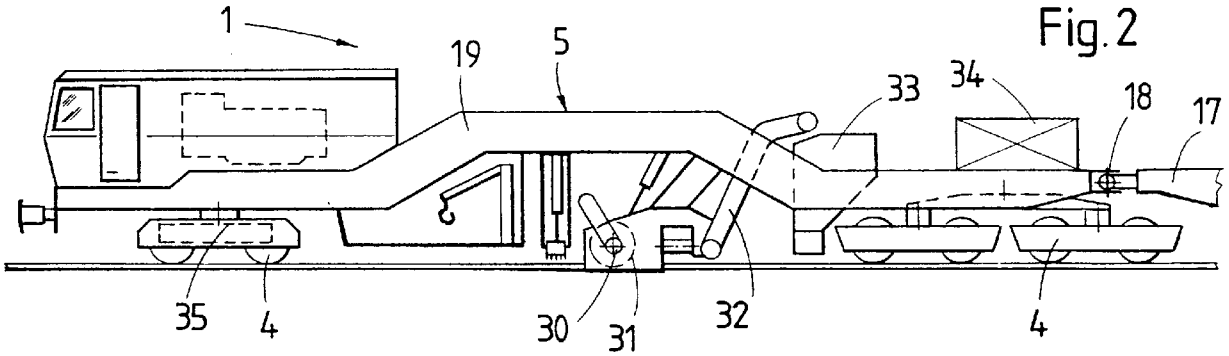
FIG. 2 is a like view of the rear part of the ballast cleaning machine.

FIGS. 1 and 2 show ballast cleaning machine 1 for cleaning ballast bed 2 supporting track 3. The ballast cleaning machine comprises machine frame 5 extending in a longitudinal direction and supported on the track by undercarriages 4 for movement in an operating direction indicated by arrow 15. One of the undercarriages 4 at a front end of the machine frame is displaceable in the longitudinal direction, being slidable in a guide 16 in machine frame 5 for displacement relative to the machine frame. Two vertically and laterally adjustable endless ballast excavating chains 7, 8 are sequentially arranged in the longitudinal direction for excavating ballast 10 from the ballast bed, and they are mounted on machine frame 5 between undercarriages 4. Drives 6 vertically and laterally adjust each endless ballast excavating chain, and drives 9 revolve the same for excavating the ballast into which a transverse front strand of the chains is immersed underneath track 3.

According to this invention, a respective operator's cab 11 is mounted on machine frame 5 in view of each endless ballast excavating chain 7, 8, and a control 12 for drives 6, 9 is arranged in each operator's cab. At least two track lifting devices 14 operated by vertical adjustment drives 13 are mounted on the machine frame. Screening installation 23 for cleaning ballast 10 is mounted on a car 24 linked to machine frame 5 at a front end thereof.

A first conveyor arrangement for conveying the ballast excavated by the two endless ballast excavating chains 7, 8 to screening installation 23 comprises a conveyor arrangement 20 extending from input end 21 below a discharge end of endless ballast excavating chain 7 and receiving excavated ballast therefrom to output end 22 discharging the excavated ballast into screening installation 23, and a conveyor arrangement 25 extending from input end 26 below a discharge end of endless ballast excavating chain 8 and receiving excavated ballast therefrom to output end 27 discharging the excavated ballast onto conveyor arrangement 20 downstream of its output end 22.

A second conveyor arrangement 28 for distributing the cleaned ballast from screening installation 23 to ballast bed 2 extends in the longitudinal direction above first endless ballast excavating chain 7, passes through a central space defined by second endless ballast excavating chain 8 trailing the first endless ballast excavating chain in the operating direction, and ends in a ballast discharge 29 positioned between machine frame 5 and track 6.

In the illustrated embodiment, machine frame 5 is comprised of two machine frame parts 17, 19 linked together by articulated coupling 18, one undercarriage 4 supporting both machine frame parts on track 3 at articulated coupling 18. The two endless ballast excavating chains 7, 8 are mounted on first machine frame part 17, and the undercarriage 4 displaceable in the longitudinal direction supports an end of the first machine frame part 17. The second machine frame part 19 trailing first machine frame part 17 in the operating direction carries, between undercarriages 4 supporting the second machine frame part at its ends, a brush 31 rotated by drive 30, a ballast silo 33, and a conveyor band 32 for conveying ballast swept by the brush to the ballast silo. Second machine frame part 19 also carries power source 34 supplying power to drive means 35 for moving the machine along the track as well as the various operating drives mounted on the machine.

As shown, one of the track lifting devices 14 is associated with first endless ballast excavating chain 7 and another one of the track lifting devices is mounted on machine frame 5 at ballast discharge 29.

Figure 3:
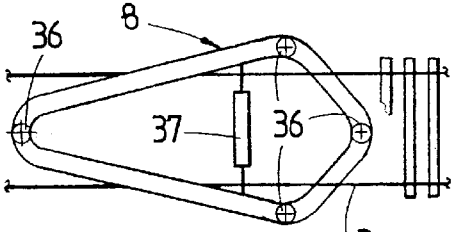
FIG. 3 is a schematic top view of a modified embodiment of an endless ballast excavating chain that may be used in the ballast cleaning machine.

An advantageous embodiment of the endless ballast excavating chain 8, disclosed in U.S. Pat. No. 4,614,238, is shown schematically in FIG. 3. This endless ballast excavating chain has portions linked together by articulated couplings 36, which chain portions may be repositioned by adjustment drive 37. This enables the operating width of the endless ballast excavating chain to be rapidly and smoothly adjusted for adaptation to different widths of the ballast bed. In this way, ballast cleaning machine 1 may also be used in track switches by operation of the adjusted second endless ballast excavating chain while first endless ballast excavating chain 7 remains inoperative.

Ballast cleaning machine 1 is operated in the following manner:

Immediately before the ballast cleaning operation is started, foremost undercarriage 4 supporting machine frame 5 on track 3 is displaced from its retracted transit position indicated in phantom lines in FIG. 1 to the operating position shown in full lines. This enlarges the excavating section defined between the foremost undercarriage and the next following undercarriage where between endless ballast excavating chains 7, 8 are mounted on the machine frame. This facilitates lifting of the track section between the two undercarriages under which the supporting ballast bed is excavated.

As ballast cleaning machine 1 continuously advances along the track, an upper layer of ballast bed 2 is excavated by endless ballast excavating chain 7 in a first operating stage. Excavated ballast 10 is conveyed by conveyor arrangement 20 from input end 21 to output end 22 for discharge into screening installation 23. As required by operating conditions, an operator in operator's cab 11 within view of endless ballast excavating chain 7 may operate control 12 for actuating drives 6 and 9.

While track 3 remains raised by track lifting device 14, a second layer of ballast is excavated by second endless ballast excavating chain 8 immediately behind the first endless ballast excavating chain, and the excavated ballast is conveyed by conveyor arrangement 25 from input end 26 to output end 27 for discharge onto conveyor arrangement 20 downstream of its output end 22, so that this portion of the excavated ballast is also discharged into screening installation 23. As required by operating conditions, an operator in operator's cab 11 within view of endless ballast excavating chain 8 may operate control 12 for actuating drives 6 and 9 of the second endless ballast excavating chain. Second conveyor arrangement 28 conveys the cleaned ballast from screening installation 23 to discharge 29 positioned behind second endless ballast excavating chain 8 for restoring ballast bed 2 before track 3 is lowered onto the restored ballast bed for support thereon.

Rotatable brush 31 enables any ballast falling onto the track ties as well as any excessive ballast to be swept off the track, the swept ballast being conveyed into ballast silo 33 by conveyor band 32.

What is claimed is:

1. A ballast cleaning machine for cleaning a ballast bed supporting a track, which comprises (a) a machine frame extending in a longitudinal direction and supported on the track by undercarriages for movement in an operating direction, (1) one of the undercarriages at an end of the machine frame being displaceable in the longitudinal direction, (b) two vertically and laterally adjustable endless ballast excavating chains sequentially arranged in the longitudinal direction for excavating ballast from the ballast bed and mounted on the machine frame next to each other between the undercarriages without any undercarriage positioned between the two sequentially arranged ballast excavating chains, (c) drives for vertically and laterally adjusting, and for revolving, each endless ballast excavating chain, (d) a respective operator's cab mounted on the machine frame in view of each endless ballast excavating chain (1) a control for the drives being arranged in each operator's cab, (e) at least two track lifting devices mounted on the machine frame, (f) a screening installation for cleaning ballast mounted on a car linked to the machine frame, (g) a first conveyor arrangement for conveying the ballast excavated by the two endless ballast excavating chains to the screening installation, and (h) a second conveyor arrangement for distributing the cleaned ballast from the screening installation to the ballast bed.

2. The ballast cleaning machine of claim 1, wherein the machine frame is comprised of two machine frame parts linked together by an articulated coupling, one of the undercarriages supporting both machine frame parts on the track at the articulated coupling.

3. The ballast cleaning machine of claim 2, wherein the two endless ballast excavating chains are mounted on a first one of the machine frame parts, the one undercarriage displaceable in the longitudinal direction supporting an end of the first machine frame part.

4. The ballast cleaning machine of claim 3, wherein a second one of the machine frame parts trailing the first machine frame part in the operating direction carries a rotatably driven brush, a ballast silo, and a conveyor band for conveying ballast swept by the brush to the ballast silo.

5. The ballast cleaning machine of claim 1, wherein the second conveyor arrangement extends in the longitudinal direction above a first one of the endless ballast excavating chains, passes through the spaced define by a second one of the endless ballast excavating chains trailing the first endless ballast excavating chain in the operating direction, and ends in a ballast discharge positioned between the machine frame and the track.

6. The ballast cleaning machine of claim 5, wherein one of the track lifting devices is associated with the first endless ballast excavating chain and another one of the track lifting devices is mounted on the machine frame at the ballast discharge.

* * * * *